US008181883B1

(12) United States Patent
Franklin

(10) Patent No.: US 8,181,883 B1
(45) Date of Patent: May 22, 2012

(54) MAGNETIC STRIP PROTECTING ASSEMBLY AND METHOD

(76) Inventor: Guy R. Franklin, Fort Washington, MD (US)

( * ) Notice: Subject to any disclaimer, the term of this patent is extended or adjusted under 35 U.S.C. 154(b) by 703 days.

(21) Appl. No.: 12/196,049

(22) Filed: Aug. 21, 2008

(51) Int. Cl.
*G06K 19/06* (2006.01)

(52) U.S. Cl. ..... 235/493; 235/449

(58) Field of Classification Search ..... 235/493, 235/487, 449; 428/34.2, 35.2
See application file for complete search history.

(56) References Cited

U.S. PATENT DOCUMENTS 4,149,667 A * 4/1979 Riley ..... 229/72
4,711,347 A * 12/1987 Drexler et al. ..... 206/38
4,851,610 A 7/1989 LeBlanc et al.
D353,322 S 12/1994 Oshry et al.
5,506,395 A * 4/1996 Eppley ..... 235/486
5,556,683 A 9/1996 Ranalli
5,841,375 A * 11/1998 Kondo et al. ..... 341/50
5,941,375 A 8/1999 Kamens et al.
6,247,587 B1 6/2001 Yu
6,845,863 B1 * 1/2005 Riley ..... 206/39

* cited by examiner

*Primary Examiner* — Daniel St.Cyr

(57) ABSTRACT

A magnetic strip protecting assembly includes a sleeve that has a bottom edge, a top edge, a first lateral edge and a second lateral edge. The top edge is open and defines an access opening into the sleeve. Each of the bottom, first lateral and second lateral edges is closed. A card having a magnetic strip thereon encoded with information is positionable into the sleeve through the access opening to protect the magnetic strip while allowing the card to be scanned by a magnetic strip reader. The sleeve has a first side and a second side. The first side comprises a first panel section of the sleeve and the second side comprising a second panel section of the sleeve. Each of the first and second panel sections comprises a plastic material that has anti-static properties.

8 Claims, 4 Drawing Sheets

MAGNETIC STRIP PROTECTING ASSEMBLY AND METHOD

BACKGROUND OF THE INVENTION

Field of the Invention

The present invention relates to magnetic strip protecting devices and more particularly pertains to a new magnetic strip protecting device for preventing damage to a magnetic strip while allowing the magnetic strip to be read.

SUMMARY OF THE INVENTION

The present invention meets the needs presented above by generally comprising a sleeve that includes a bottom edge, a top edge, a first lateral edge and a second lateral edge. The top edge is open and defines an access opening into the sleeve. Each of the bottom, first lateral and second lateral edges is closed. A card having a magnetic strip thereon encoded with information is positionable into the sleeve through the access opening to protect the magnetic strip while allowing the card to be scanned by a magnetic strip reader. The sleeve has a first side and a second side. The first side comprises a first panel section of the sleeve and the second side comprising a second panel section of the sleeve. Each of the first and second panel sections comprises a plastic material that has anti-static properties.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
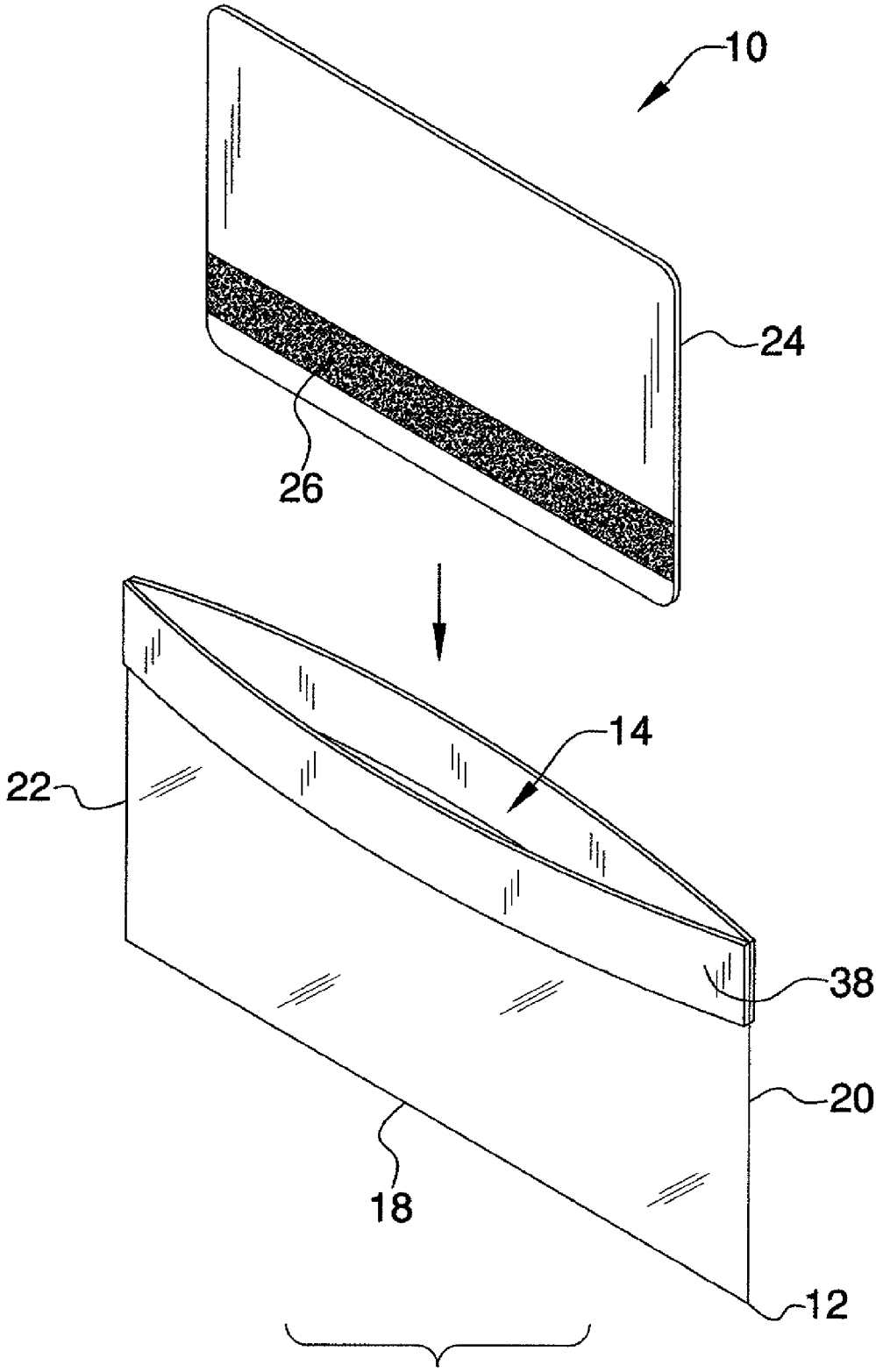
FIG. 1 is a perspective view of a magnetic strip protecting assembly and method according to the present invention.
Figure 3:
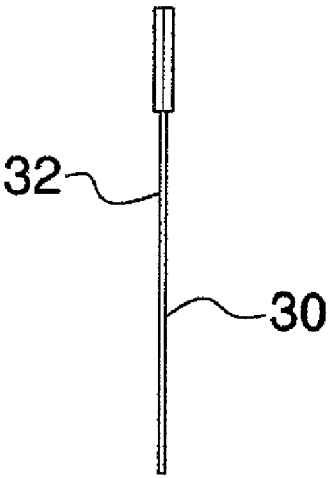
FIG. 3 is a side view of the present invention.
Figure 2:
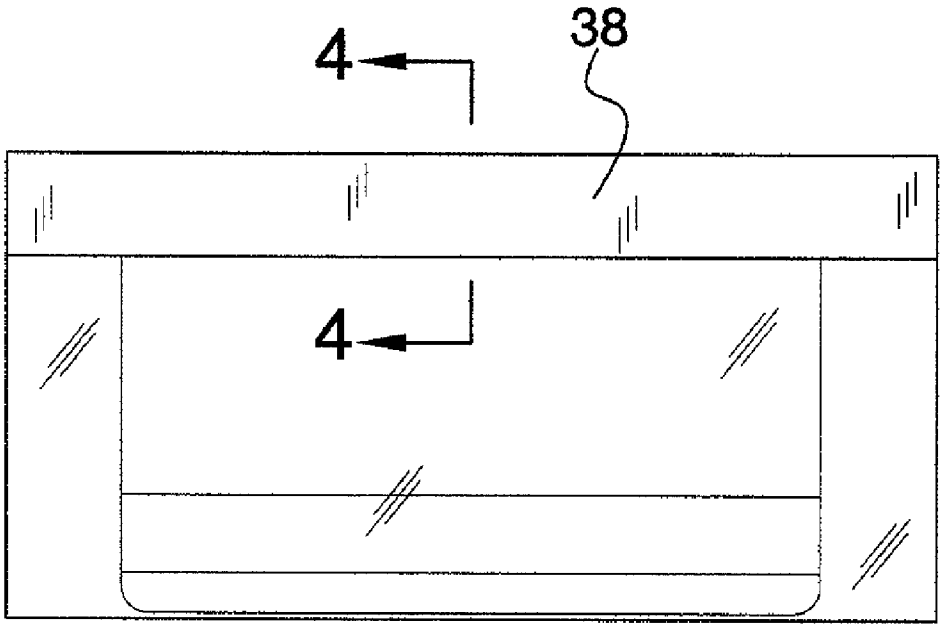
FIG. 2 is a rear view of the present invention.
Figure 5:
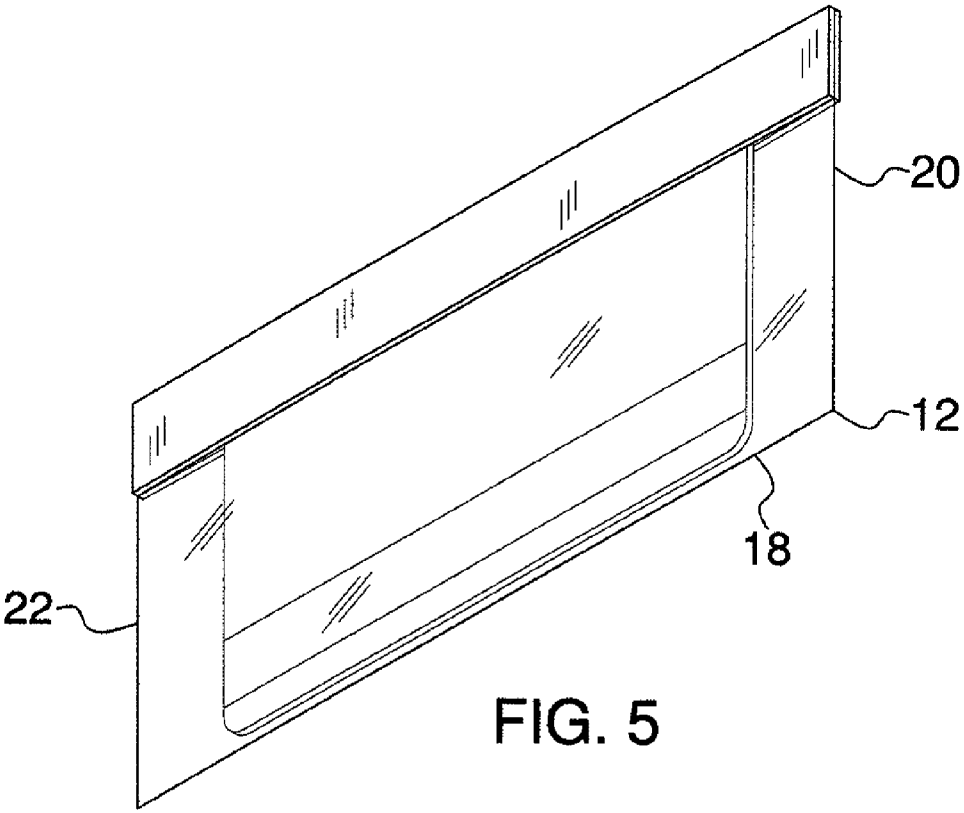
FIG. 5 is a bottom perspective view of the present invention.
Figure 4:
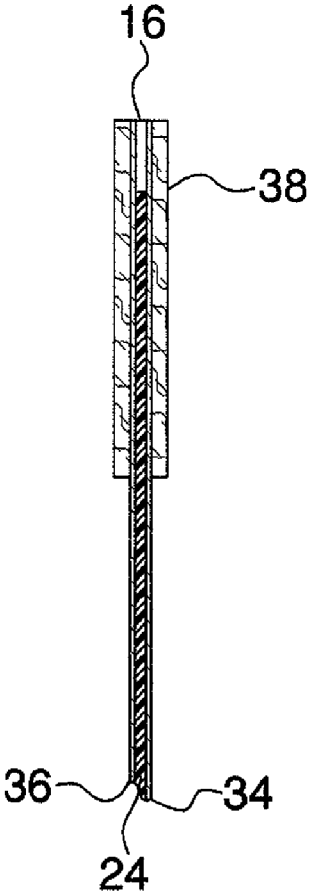
FIG. 4 is a cross-sectional view taken along line 4-4 of FIG. 2 of the present invention.
Figure 6:
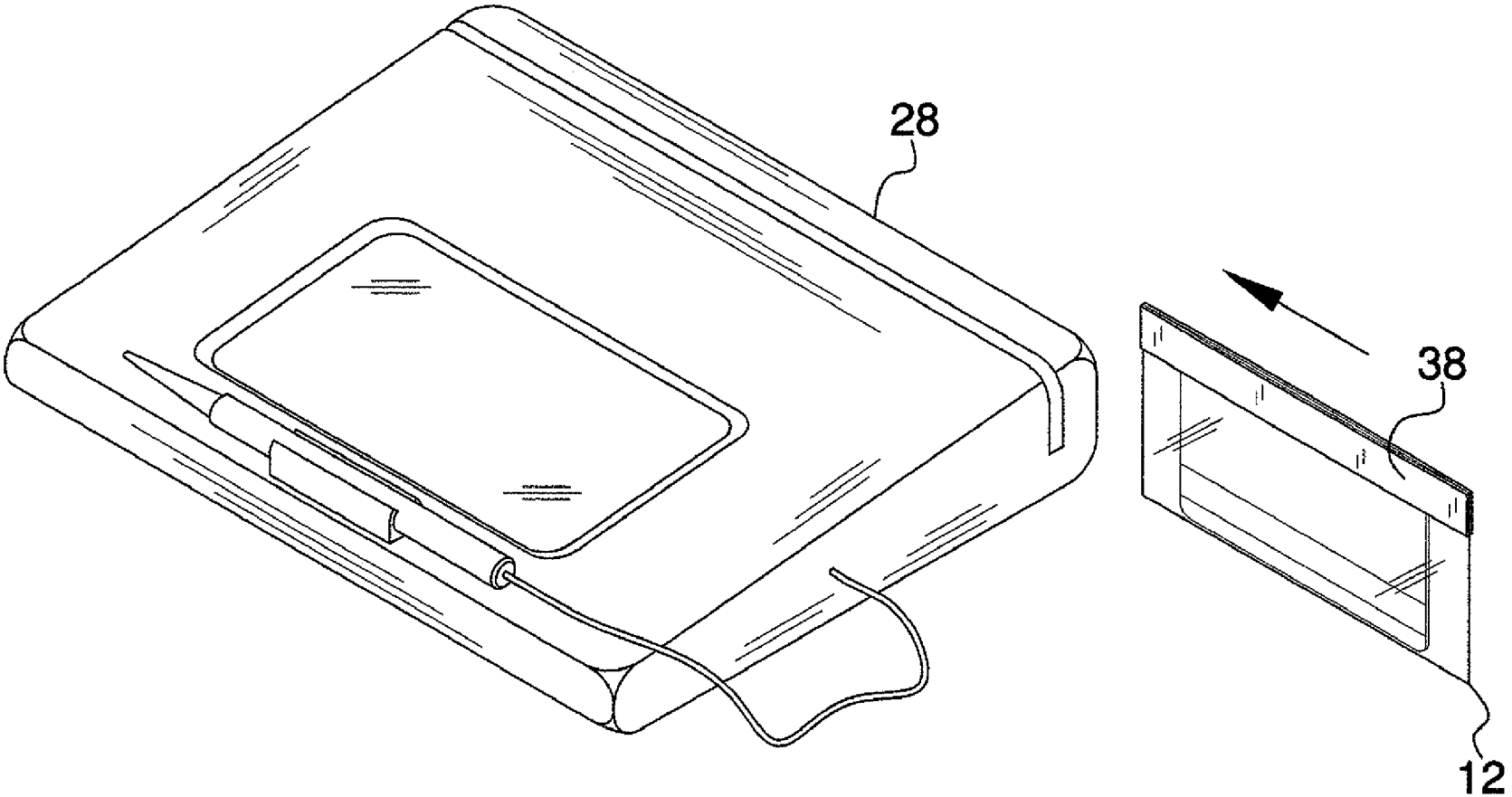
FIG. 6 is an in-use view of the present invention.

With reference now to the drawings, and in particular to FIGS. 1 through 6 thereof, a new magnetic strip protecting device embodying the principles and concepts of the present invention and generally designated by the reference numeral 10 will be described.

As best illustrated in FIGS. 1 through 6, the magnetic strip protecting assembly and method 10 generally comprises a sleeve 12 that includes a bottom edge 18, a top edge 16, a first lateral edge 20 and a second lateral edge 22. The top edge 16 is open and defines an access opening 14 into the sleeve 12. Each of the bottom 18, first lateral 20 and second lateral 22 edges is closed. A card 24, such a credit card, bank card, debit card or the like, having a magnetic strip 26 thereon encoded with information is positionable into the sleeve 12 through the access opening 14 to protect the magnetic strip 26 while allowing the card 24 to be scanned by a magnetic strip reader 28.

The sleeve 12 has a first side 30 and a second side 32. The first side 30 comprises a first panel section 34 of the sleeve 12 and the second side 32 comprises a second panel section 36 of the sleeve 12. These may be formed by a single panel folded in half to form the first 34 and second 36 panel panels sections which have there lateral edges adhered together by any conventional bonding means to form the first 20 and second 22 lateral edges. Each of the first 34 and second 36 panel sections comprises a plastic material that has anti-static properties. Suitable plastic materials are readily available from a variety of sources and are typically used for shielding electronic equipment for storage or transportation. Each of the first 34 and second 36 panel sections has a width between 1 mil and 5 mil. The plastic material is sufficiently transparent to view the card when the card 24 is positioned in the sleeve 12 and in particular to read any indicia on the card 24. The sleeve 12 has a length from the first lateral edge 20 to the second lateral edge 22 between 3.5 inches and 5 inches and the sleeve has a height from the bottom edge 18 to the top edge 16 between 2 inches and 2.5 inches.

A border member 38 is attached to the sleeve 12 and is coextensive with the top edge 16. The border member 38 comprises a material having greater rigidity than the sleeve 12 such as a paper cardboard material. The border member 38 may be attached to the first 32 and second 30 sides with an adhesive material and it will have a height of less than 1.5 inches. The border member 18 adds some rigidity to the sleeve 12 for easier opening and manipulation thereof.

In use, a card 24 having a magnetic strip 26 is placed in the sleeve 12 to protect it from static and from friction caused by the card 24 being repeatedly removed and inserted into a wallet or purse. This will increase the longevity of the magnetic strip 26 and will increase the success rate of a magnetic strip reader 28 being able to read the magnetic strip 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of protecting a magnetic strip, said method comprising the steps of:

providing a card having a magnetic strip thereon containing encoded information readable by a magnetic strip reader;

providing a sleeve having a bottom edge, a top edge, a first lateral edge and a second lateral edge, said top edge being open and defining an access opening into said sleeve, said access opening extending from said first lateral edge to said second lateral edge, said access opening comprising an only opening extending into said sleeve, each of said bottom, first lateral and second lateral edges being closed;

providing a border member being attached to said sleeve and being coextensive with said top edge, said border member comprising a material having greater rigidity than said sleeve;

positioning said card in said sleeve; and sliding said sleeve through a magnetic strip reader such that said border member is positioned in parallel spaced relationship to said magnetic strip reader while said sleeve is sliding through said magnetic strip reader.

2. The method according to claim 1, wherein the step of providing said sleeve further includes the step of said sleeve having a first side and a second side, said first side comprising a first panel section of said sleeve and said second side comprising a second panel section of said sleeve, each of said first and second panel sections comprising a plastic material having anti-static properties, said first and second sides being completely solid and free from openings from said first lateral edge to said second lateral edge.

3. The method according to claim 1, wherein the step of providing said sleeve further includes the step of said sleeve having a length from said first lateral edge to said second lateral edge between 3.5 inches and 5 inches, said sleeve having a height from said bottom edge to said top edge between 2 inches and 2.5 inches.

4. The method according to claim 1, wherein the step of providing said sleeve further includes the step of each of said first and second panel sections having a width between 1 mil and 5 mil.

5. The method according to claim 1, wherein the step of providing said sleeve further includes the step of said plastic material being sufficiently transparent to view the card when the card is positioned in said sleeve.

6. The method according to claim 1, wherein the step of providing said border material further includes the step of said border member comprising a paper cardboard material.

7. The method according to claim 6, wherein the step of providing said sleeve further includes the step of said sleeve having a length from said first lateral edge to said second lateral edge between 3.5 inches and 5 inches, said sleeve having a height from said bottom edge to said top edge between 2 inches and 2.5 inches.

8. The method according to claim 7, wherein the step of providing said sleeve further includes the step of each of said first and second panel sections having a width between 1 mil and 5 mil.

* * * * *